US008240162B2

(12) United States Patent
Taras et al.

(10) Patent No.: US 8,240,162 B2
(45) Date of Patent: Aug. 14, 2012

(54) ENGINE DRIVEN REFRIGERANT COMPRESSOR WITH PULSE WIDTH MODULATION CONTROL

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 722 days.

(21) Appl. No.: 12/445,644

(22) PCT Filed: Oct. 18, 2006

(86) PCT No.: PCT/US2006/040966

§ 371 (c)(1),
(2), (4) Date: Apr. 15, 2009

(87) PCT Pub. No.: WO2008/048264

PCT Pub. Date: Apr. 24, 2008

(65) Prior Publication Data

US 2010/0212337 A1 Aug. 26, 2010

(51) Int. Cl.
*F25B 49/00* (2006.01)

(52) U.S. Cl. ..... 62/228.1; 62/228.4

(58) Field of Classification Search ..... 62/180, 62/181, 183, 228.1, 228.4; 123/319
See application file for complete search history.

(56) References Cited

U.S. PATENT DOCUMENTS 5,309,730 A 5/1994 Strand et al.
5,351,503 A * 10/1994 Sugimoto et al. ..... 62/429
2007/0041224 A1* 2/2007 Moyse et al. ..... 363/21.01

OTHER PUBLICATIONS

Search Report and Written Opinion mailed on Apr. 3, 2007 for PCT/US2006/040966.
International Preliminary Report on Patentability dated Apr. 30, 2009.

* cited by examiner

*Primary Examiner* — Marc Norman
(74) *Attorney, Agent, or Firm* — Carlson, Gaskey & Olds, PC

(57) ABSTRACT

A fuel-powered engine is provided to drive a mobile air conditioning or refrigeration unit such as a portable chiller, a container refrigeration unit, a portable packaged system, a transport tractor-trailer or truck refrigeration unit, etc. A control rapidly changes the engine speed between the predefined set of discreet engine speeds to precisely adjust the capacity of the refrigerant system. If the engine operates only at a single speed, then the control cycles the engine between this operating speed and a zero speed (the engine is shut off). If the engine can operate at multiple discreet speeds, then the control can cycle the engine between any of these speeds (including a zero speed). When a lower capacity is desirable, the engine operates for a longer time interval at a lower speed, and when a higher capacity is desirable, the engine operates for a longer period of time at a higher speed. The cycle rate is selected to control the comfort (e.g. temperature and/or humidity) of the conditioned environment within the specified tolerance band, while conforming to the reliability requirements.

20 Claims, 1 Drawing Sheet

ENGINE DRIVEN REFRIGERANT COMPRESSOR WITH PULSE WIDTH MODULATION CONTROL

This application is a United States National Phase application of PCT Application No. PCT/US2006/040966 filed Oct. 18, 2006.

BACKGROUND OF THE INVENTION

This application relates to a refrigerant system wherein an engine, such as an internal combustion engine, is utilized to provide power to mobile air conditioning equipment, and wherein a pulse width modulation control for the engine is provided to allow variation in the refrigerant system capacity.

Refrigerant systems are utilized to condition a secondary fluid, such as air. One class of refrigerant system applications is related to mobile air conditioning or refrigeration equipment. This class of mobile applications includes portable chillers, portable packaged systems, mobile container refrigeration units, transport tractor-trailer or truck refrigeration systems, etc. Components for the refrigerant system, such as compressors, fans and pumps are typically driven by an engine power source, using clutches, belts, couplings and other similar components.

The requirements on the cooling (or heating) capacity to be delivered to the conditioned spaces vary, for example, due to internal load within the conditioned environment as well as ambient conditions. In the past, various techniques for component unloading or decreasing the capacity of the refrigerant system have been utilized for mobile air conditioning and refrigeration equipment. One of such techniques included operation of the engine at two discrete speeds. When lower capacity was required, the engine was operating at a lower speed, and when a higher capacity was required, the engine was operating at a higher speed. Since the engine was coupled to a compressor, when the engine speed was reduced the compressor speed would also be reduced proportionally. As the compressor was operating at a lower speed, it would be delivering less refrigerant circulating throughout a refrigerant system and subsequently provide lower capacity to the environment to be conditioned. However, in this case, the capacity of the system could only vary in two digitized increments corresponding to at a high or low speed of continuous operation. When the engine cycles from a high to low speed, it would operate at a particular speed for a long period of time (typically from 10 minutes to several hours). Since the engine and the compressor would stay at a given speed for such a long period of time, the temperature of the conditioned environment could not be precisely controlled. Thus, other means (often very expensive and inefficient) for fine-tuning the delivered capacity were required. These means, for example, included the use of a suction modulation valve. When a reduced capacity is desired, the opening through the suction modulation valve is decreased, causing the reduction of refrigerant delivered to the compressor. While effective in terms of capacity reduction, this technique results in inefficient operation requiring extra undesirable fuel consumption and decreased refueling intervals. Thus, the need exists to improve engine fuel consumption while maintaining tight temperature control in the conditioned environment.

It is also known to provide pulse width modulation control for various components in a refrigerant system to control delivered capacity. In one known type of pulse width modulation control, a system control rapidly cycles a suction valve between open and closed positions to control the amount of refrigerant delivered to a compressor. In this manner, as known, the capacity provided by the refrigerant system would be reduced. This technique, while applied to a suction valve, has not been utilized or adapted to rapidly cycle between the speeds of the multi-speed engine driving the refrigerant system components.

SUMMARY OF THE INVENTION

In a disclosed embodiment of this invention, a control is provided to rapidly change speed of an engine providing power to a refrigerant system. When it is determined that a reduced capacity is required, the pulse width modulation control rapidly cycles the engine either between ON and OFF positions or between discrete engine speeds. In this manner, the temperature within the conditioned environment can be tightly controlled (the engine can be cycled rapidly enough, such that the temperature within the conditioned environment is not appreciably affected) and the amount of fuel consumed by the engine is reduced as compared to other less efficient methods used to tightly control temperature within the conditioned environment.

The engine may be a two-speed (or multi-speed with more than two discrete operating speeds) engine and the cycling may be between higher and lower speeds. Alternatively, it can also be a single speed engine, where the engine is rapidly cycled between ON and OFF positions. Again, the pulse width modulation control can rapidly cycle the engine between these predefined positions.

These and other features of the present invention can be best understood from the following specification and drawings, the following of which is a brief description.

DETAILED DESCRIPTION OF THE PREFERRED EMBODIMENTS

Figure 1:
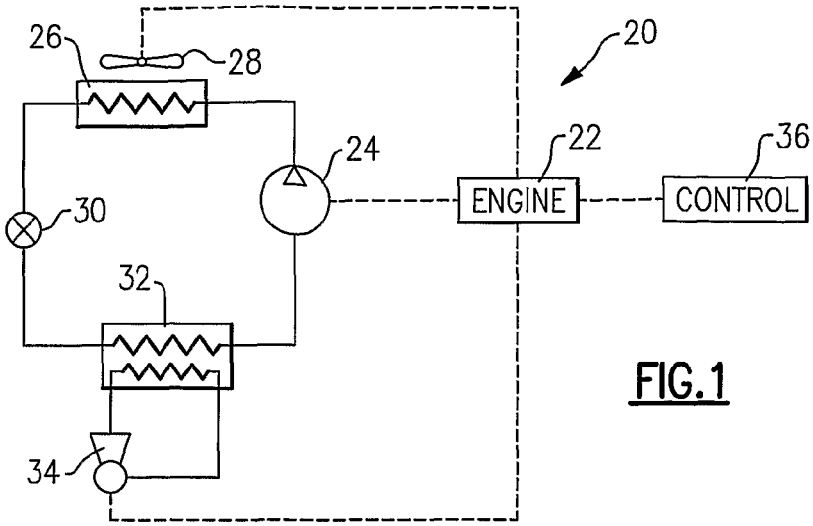
FIG. 1 is a schematic view of a refrigerant system incorporating the present invention.

A refrigerant system 20 is illustrated in FIG. 1. The refrigerant system 20 is a portable air conditioning or refrigeration system, and may be, for instance, a portable chiller, a portable packaged system, a mobile container refrigeration unit, a transport tractor-trailer refrigeration unit, or a truck-based refrigerator.

As is known, an engine 22 typically drives a compressor 24 to compress a refrigerant. The refrigerant is then delivered throughout the refrigerant system 20. The engine 22 typically also provides power to a fan 28 for moving air over a condenser 26 and to a pump 34 for pumping secondary fluid through an evaporator 32.

The refrigerant flows from the compressor 24 to the condenser 26 and then downstream to an expansion device 30 and to the evaporator 32. The illustrated embodiment is an air-cooled chiller, and in other applications, air may be driven over the evaporator 32 by a fan and into a conditioned space such as in the case of a mobile container refrigeration unit, etc. In these applications, the engine 22 that powers the pump 34 would also power the evaporator fan. Of course, a pump that can be delivering a cooling media, such as water or glycol, to cool the condenser, can also replace the fan 28. Also, as stated above, a refrigerant system 20 illustrated in FIG. 1 is a basic refrigerant system and may have various options and enhancement features. All these systems (including heat pump systems) are within the scope and can equally benefit from the present invention.

The refrigerant system 20, as described to this point, may generally be as known in the art. As mentioned above, at times, the required capacity to cool the secondary fluid, or to cool air being delivered into a conditioned environment, may need to be reduced. Thus, the prior art has utilized various unloading techniques to reduce the provided capacity. However, these techniques have not rapidly cycled the engine 22 to precisely control the delivered capacity, while minimizing the fuel consumption, as well as comfort (e.g. temperature and humidity levels) in the conditioned environment, to satisfy specification requirements.

Figure 2A:
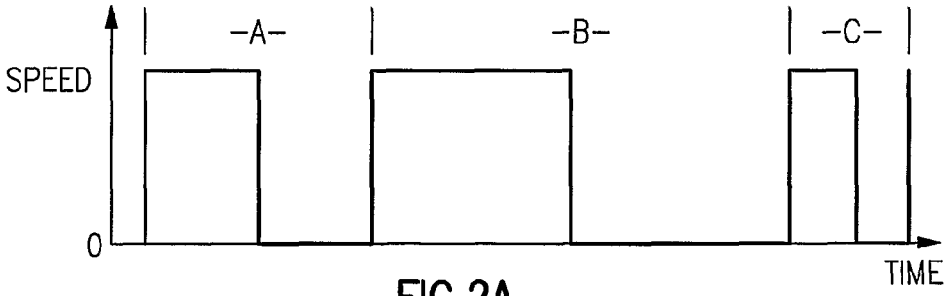
FIG. 2A is a speed versus time graph for one embodiment of the present invention.
Figure 2B:
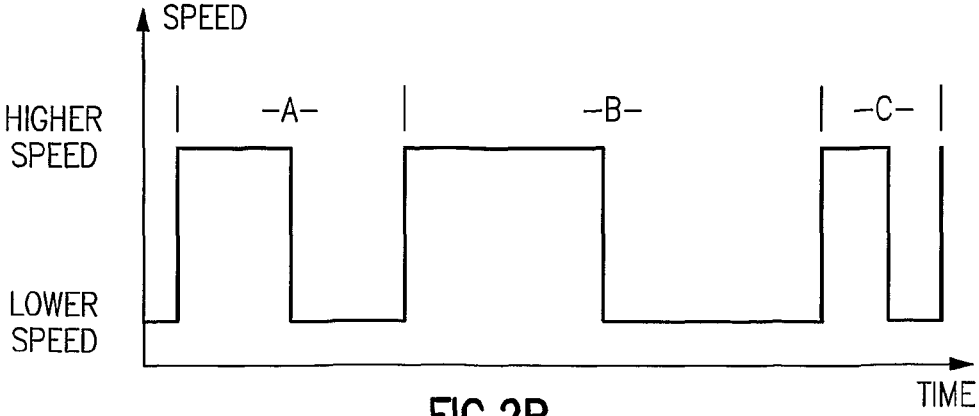
FIG. 2B is a speed versus time graph for a second embodiment of the present invention.

The present invention provides a pulse width modulation control 36 for the engine 22. In one embodiment, the engine 22 may be a single speed engine. The control 36 operates this engine between the predetermined single speed and zero speed in a cycled manner to adjust the flow of refrigerant delivered by the compressor 24 (since the compressor shaft is coupled to the engine shaft, the compressor would deliver no refrigerant at a zero speed), This method minimizes the fuel consumption, since there no fuel consumed when the engine is shut off (at a zero speed). This is shown in FIG. 2A. In a second embodiment, engine may have at least two speeds (a higher speed and a lower speed). In this embodiment, the pulse width modulation control 36 may operate the multi-speed engine between these two speeds using pulse width modulation control method. Of course, in reality, the engine may have more than two discrete speeds. In this case, the control can cycle the engine between any of these speeds, including a zero speed (when the engine is shut off). This embodiment is illustrated in FIG. 2B, in particular, for a control that only cycles the engine between the higher and lower speed.

With either embodiment, the amount of fuel consumed by the engine at times when low capacity is required, is reduced. The amount of required capacity delivered by the compressor could be closely controlled by defining the amount of time the engine operates at a higher speed vs. lower speed operation. When more capacity is desired, the ratio of these time intervals (that is equal to the amount of time the engine spends at a higher speed divided by the amount of time the engine spends at a lower speed) will increase. Similarly, for a single speed unit, which alternates between an ON and OFF position, the amount of time in an ON engine position will be increased when more capacity is desired. It should be pointed out that the time period of one cycle (the amount of time at a higher speed plus the amount of time at a lower speed within one cycle) can be adjusted by the control. A default cycle time is shown at A in FIGS. 2A and 2B. If, for instance, it is determined that the comfort (e.g. temperature and/or humidity) is not controlled tightly within the conditioned environment, the cycle time interval is reduced (cycle time C). However, if it is determined that there is a very tight temperature control within the conditioned environment, then the cycle time interval can be increased (cycle time B) and the temperature control requirements relaxed. Typically, a lower cycle time interval corresponds to a tighter temperature control within the conditioned environment, but potentially reduces reliability of the engine, compressor and other coupled components (such as fans and pumps) due to increased number of cycles. Therefore, the constraints on the cycle time interval can be pre-programmed into the controller taking into account the reliability considerations and comfort (e.g. temperature and/or humidity) control requirements for particular field applications. For typical applications, to maintain a tight temperature control (+/−1 F or better) within the conditioned environment, the cycle time interval needs to be in the range of 10 seconds to 1 minute, which is much faster cycling that has been attempted in the past. In this case, so-called thermal (cooling/heating) inertia constant of the refrigerant system is higher than the time period of a pulse width modulation cycle (in other words, if the unit is cycled fast enough, the temperatures within the unit does not have time to change substantially to affect the temperature within the conditioned space). The engine pulse width modulation technique described in this invention can be used in conjunction with different types of refrigerant systems, that may in addition to what shown in FIG. 1, include the following features: an economized vapor injection cycle, an unloading bypass line connecting intermediate compression stage back to suction, a suction modulation valve, a pulse width modulation valve, a reheat circuit and other known components that enhance the functionality and operation of the refrigerant system. Also, this invention is not limited to any particular type of a compressor or engine. For example, a piston or rotary type engine and scroll, rotary, reciprocating or screw compressors are well within the scope of the present invention. The system can also consists of multiple compressors, each driven by an independent engine, or several compressors coupled to a single engine.

Although a preferred embodiment of this invention has been disclosed, a worker of ordinary skill in this art would recognize that certain modifications would come within the scope of this invention. For that reason, the following claims should be studied to determine the true scope and content of this invention.

We claim

1. A refrigerant system comprising:

a fuel-powered engine, said fuel-powered engine at least driving a compressor;

said compressor compressing a refrigerant and delivering refrigerant to a downstream condenser, refrigerant passing through said condenser, through an expansion device and then through an evaporator, refrigerant returning from said evaporator back to said compressor;

a secondary fluid being cooled at said evaporator; and a pulse width modulation control for said fuel-powered engine, said pulse width modulation control operating said engine between a higher speed and a lower speed in a rapid cycle to adjust at least the refrigerant system capacity.

2. The refrigerant system as set forth in claim 1, wherein said lower speed is zero speed.

3. The refrigerant system as set forth in claim 1, wherein said higher and lower speeds are non-zero operating speeds.

4. The refrigerant system as set forth in claim 1, wherein said fuel-powered engine has a single operating speed, and said pulse width modulation control cycling said fuel-powered engine between said single operating speed and zero speed.

5. The refrigerant system as set forth in claim 1, wherein said fuel-powered engine has at least two operating speeds, with said pulse width modulation control rapidly cycling said engine between said operating speeds.

6. The refrigerant system as set forth in claim 1, wherein said fuel-powered engine has at least two operating speeds, with said pulse width modulation control rapidly cycling said engine between said at least two operating speeds and zero speed.

7. The refrigerant system as set forth in claim 1, wherein said rapid cycle is based upon a determined cycle time interval which is relied upon for rapidly cycling the engine between said higher speed and said lower speed.

8. The refrigerant system as set forth in claim 7, wherein the said pulse width modulation control adjusts the time interval of said rapid cycle to meet at least the reliability and temperature control requirements.

9. The refrigerant system as set forth in claim 7, wherein said cycle time interval is between 10 seconds and 1 minute.

10. The refrigerant system as set forth in claim 7, wherein said pulse width modulation control adjusts the determined cycle time interval based upon changing conditions to change a ratio of the time the engine spends at a higher speed and a lower speed.

11. A method of operating a refrigerant system including:

providing a fuel-powered engine, said fuel-powered engine at least driving a compressor;

said compressor compressing a refrigerant and delivering refrigerant to a downstream condenser, refrigerant passing through said condenser, through an expansion device and then through an evaporator, refrigerant returning from said evaporator back to said compressor;

providing a secondary fluid being cooled at said evaporator; and providing a pulse width modulation control for said fuel-powered engine, said pulse width modulation control operating said engine between a higher speed and a lower speed in a rapid cycle to adjust at least the refrigerant system capacity.

12. The method as set forth in claim 11, wherein said lower speed is zero speed.

13. The method as set forth in claim 11, wherein said higher and lower speeds are non-zero operating speeds.

14. The method as set forth in claim 11, wherein said fuel-powered engine has a single operating speed, and said pulse width modulation control cycling said fuel-powered engine between said single operating speed and zero speed.

15. The method as set forth in claim 11, wherein said fuel-powered engine has at least two operating speeds, with said pulse width modulation control rapidly cycling said engine between said operating speeds.

16. The method as set forth in claim 11, wherein said fuel-powered engine has at least two operating speeds, with said pulse width modulation control rapidly cycling said engine between said at least two operating speeds and zero speed.

17. The method as set forth in claim 11, wherein said rapid cycle is based upon a determined cycle time interval which is relied upon for rapidly cycling the engine between said higher speed and said lower speed.

18. The method as set forth in claim 17, wherein said pulse width modulation control adjusts the determined cycle time interval of said rapid cycling to meet at least reliability and temperature control requirements.

19. The method as set forth in claim 17, wherein said pulse width modulation control adjusts the determined cycle time interval based upon changing conditions to change a ratio of the time the engine spends at a higher speed and a lower speed.

20. The method as set forth in claim 18, wherein said time interval is between ten seconds and one minute.

* * * * *